US009506258B2

(12) United States Patent
Amer et al.

(10) Patent No.: US 9,506,258 B2
(45) **Date of Patent: *Nov. 29, 2016**

(54) TOILET FLANGE TEMPLATE APPARATUS

(71) Applicants: Jack Amer, Cerritos, CA (US); Danny Alvarez, Cerritos, CA (US)

(72) Inventors: Jack Amer, Cerritos, CA (US); Danny Alvarez, Cerritos, CA (US)

( * ) Notice: Subject to any disclaimer, the term of this patent is extended or adjusted under 35 U.S.C. 154(b) by 139 days.

This patent is subject to a terminal disclaimer.

(21) Appl. No.: 14/333,481

(22) Filed: Jul. 16, 2014

(65) Prior Publication Data

US 2015/0152649 A1 Jun. 4, 2015

Related U.S. Application Data

(63) Continuation-in-part of application No. 14/096,027, filed on Dec. 4, 2013, now Pat. No. 9,091,076.

(51) Int. Cl.

| | |
|---|---|
| ***G01B 3/14*** | (2006.01) |
| ***E04F 15/02*** | (2006.01) |
| ***E04F 21/00*** | (2006.01) |
| ***E04F 21/22*** | (2006.01) |

(52) U.S. Cl.

CPC ..... *E04F 21/22* (2013.01); *E04F 21/0076* (2013.01); *Y10T 29/4984* (2015.01)

(58) Field of Classification Search

CPC ..... E04F 15/02177; E04F 21/20; E04F 21/0076; G01B 3/14

USPC ..... 33/526, 529, 562, 565, 613, 645, 27.01

See application file for complete search history.

(56) References Cited

U.S. PATENT DOCUMENTS 2,835,981 A * 5/1958 Kaufman ..... B25H 7/005 33/529
4,233,697 A * 11/1980 Cornwall ..... E03D 11/16 138/89
4,967,422 A * 11/1990 Novak ..... E03D 11/16 138/89
5,188,013 A * 2/1993 Cardinale ..... B26D 1/045 33/527
5,996,134 A * 12/1999 Senninger ..... E03D 11/16 138/96 R
6,085,362 A * 7/2000 Huber ..... E03D 11/16 138/96 R
6,799,606 B1 * 10/2004 Howson ..... E04D 13/0409 138/89
7,716,846 B2 * 5/2010 Sanders ..... D21F 5/02 33/517
8,099,801 B2 * 1/2012 Hughes ..... E03D 11/16 285/56
8,220,174 B1 * 7/2012 Shwaiheen ..... G01B 5/25 33/529
9,206,592 B2 * 12/2015 Coronado ..... E03D 11/16
2008/0022542 A1 * 1/2008 Brosmith ..... B26B 5/00 33/562
2009/0265947 A1 * 10/2009 Sanders ..... D21F 5/02 33/517
2011/0131715 A1 * 6/2011 Culwell ..... E03D 11/16 4/252.5
2012/0240319 A1 * 9/2012 Yssel ..... E03D 11/16 4/252.1
2012/0324825 A1 * 12/2012 Vrame ..... E04B 1/38 52/745.21
2013/0167292 A1 * 7/2013 McHugh, III ..... E03D 11/16 4/252.4
2014/0223753 A1 * 8/2014 Yaphe ..... F21V 21/00 33/566
2014/0230361 A1 * 8/2014 Wood ..... E04F 21/0076 52/747.11
2014/0237836 A1 * 8/2014 Yaphe ..... G01B 3/14 33/528

* cited by examiner

*Primary Examiner* — G. Bradley Bennett
(74) *Attorney, Agent, or Firm* — John D. Tran; Rhema Law Group

(57) ABSTRACT

A method and apparatus can include: a toilet flange template apparatus comprising: a first arm having a first head and a first connecting member extending therefrom, the first head formed with a first centered boss extending therefrom; and a second arm having a second head and a second connecting member extending therefrom, the second arm being pivotally connected to the first arm, and the second arm configured to be parallel to the first arm when a tile is placed therebetween, the second head defining a perimeter edge corresponding to and providing circumferential clearance for an outer circumference of a toilet flange that the first centered boss is configured to mate with.

20 Claims, 10 Drawing Sheets

TOILET FLANGE TEMPLATE APPARATUS

CROSS-REFERENCE TO RELATED APPLICATIONS

This is a Continuation-In-Part of U.S. patent application Ser. No. 14/096,027 filed Dec. 4, 2013, and claims priority benefit to all common subject matter. The content of this application is incorporated herein by reference.

INCORPORATION-BY-REFERENCE

Any and all patents and published patent applications cited or referred to in the following specification are hereby incorporated by reference.

TECHNICAL FIELD

This disclosure relates to mechanical tools, more particularly a tool for assisting with installing flooring around a toilet flange.

BACKGROUND

By way of general background, it is customary in the art of building construction, whether commercial or residential, to install new flooring in bathrooms and the like, such flooring most often involving tile of various kinds. The installer must cut the tile or other flooring around not only all walls and other obstructions but also around any plumbing fixtures on the floor and even adjacent walls depending the design and intended installation of the tile or other material.

One specific challenge that arises in such contexts is cutting an opening in the tile or tiles about the toilet flange or closet flange, or the pipe formed in and extending slightly upwardly from the floor over which a toilet is typically installed, so as to provide clearance for such flange while substantially covering the floor thereabout, and particularly enough of the floor such that the later-installed toilet will sit substantially level or flush with the floor while leaving none of the subfloor exposed beyond the perimeter of the toilet base. As such, it is desirable to be able to cut a substantially circular, arcuate or other such opening in the one or more tiles that will surround the toilet flange before they are secured to the floor, such that the resulting opening in the tile(s) when laid approximates the toilet flange perimeter. What has been needed and has heretofore been unavailable is a means for marking flooring around a toilet flange to increase accuracy and efficiency.

One prior development described in U.S. Pat. No. 4,233,697, entitled "Protective flange cover and method of use", includes a protective cover or cap for connection to a toilet mounting flange installed on a drain or discharge pipe. The cover protects the stems of bolts for connecting the flange to the toilet by means of at least two tubular extensions on the cover which surround the bolts and by means of nuts over washers on the bolt stems when the cover is installed on the flange. The cover makes it easier to align the flange visually with the surrounding walls but fails to provide an adequate way to mark the floor around the toilet flange.

Another prior development described in U.S. Pat. No. 4,967,422, entitled "Closet flange protector", includes a closet flange protector to protect and overlie a water closet flange and test plugs during a construction proceeding. The protector includes an inverted cup-shaped member including an upper disk portion provided with spaced diametrically opposed wells. A downwardly depending skirt depends downwardly from the disk and associated wells terminating in a continuous conical skirt. The conical skirt and wells include aligned through extending apertures for receiving diametrically opposed threaded bolts. The bolts include threaded fasteners received within the wells to secure the well to a floor structure and overlie an associated water closet flange but the flange protector again fails to provide an adequate way to mark the floor around the toilet flange.

Another prior development described in U.S. Pat. No. 5,996,134, entitled "Cover, spacer and plumbing installation assembly", includes a plumbing installation assembly including a closet flange and a cooperating spacer and cover. The spacer holds the closet flange above the floor a selected height to allow the pouring of lightweight concrete. The cover fully covers the face and slotted mounting apertures in the closet flange upon which the toilet is mounted but again fails to provide an adequate way to mark the floor around the toilet flange Another prior development described in U.S. Pat. No. 6,085,362, entitled "Water closet fitting installation assembly", includes a water closet fitting installation assembly for installation and optional testing of a water closet fitting within a poured, permanently set floor. The assembly comprises a water closet fitting; a flange adapted for rotatable engagement of an outer circumference of the fitting, whereby a water closet stool may be attached to the fitting in a desired rotational orientation relative to the fitting by means of mechanical fasteners passing through holes in the flange; a collar adapted to prevent contact between the flange, the fitting, and mechanical fasteners used to mount the stool and the material in which the fitting is installed; and a temporary or removable cover plate adapted to cover the fitting and to prevent unset flooring material from entering the water closet fitting or the drain system on installation, so that the fitting and said the system are kept free from the material, and from potential blockage thereby. Embodiments of the fitting assembly further comprise a test baffle adapted to permit the water closet drain system to be tested for fluid tight integrity after the water closet fitting has been installed, without fouling the drain system with the test baffle or pieces thereof after the test has been completed and again fail to provide an adequate way to mark the floor around the toilet flange.

Another prior development described in U.S. Pat. No. 6,799,606, entitled "Drainage pipe covering kit for use during building or floor construction", includes an accessory for use in construction including a conduit that has an inlet end portion and an outlet end portion. The outlet end portion is mountable on a drainage pipe so that the conduit and the drainage pipe are in fluid communication with each other. A removable closure member is mounted on the inlet end portion to close the conduit when not in use or during building construction, so that ingress of material or detritus into the drainage pipe is inhibited but again fails to provide an adequate way to mark the floor around the toilet flange.

Another prior development described in U.S. Patent Application Publication No. 2011/0131715, entitled "Water Closet Flange Seal", includes a method of installing a closet flange that allows installation of plumbing fixtures involving telescopically fitting an inner or outer surface of a drainpipe to a surface of a cylindrical portion of a hub of a closet flange, where the hub has a base flange extending therefrom; and securing the base flange against the upper surface of a subfloor. A first layer of sealant is applied to an upper surface of the base flange; and a flooring membrane is secured to the upper surface of the base flange by the first layer of sealant.

A second layer of sealant is applied to an upper surface of the flooring membrane; and the upper surface of the flooring membrane is clamped between the base flange and a clamping ring. The method may be performed using a two-part closet flange for connection to a drain pipe for a toilet. The two-part closet flange comprises a cylindrical hub adapted to telescopically connect to the drain pipe; an annular flange radially extending from the cylindrical hub; a clamping ring; and a means to clamp a flooring membrane between the clamping ring and the annular flange but again fails to provide an adequate way to mark the floor around the toilet flange.

Another prior development described in U.S. Pat. No. 8,099,801, entitled "Closet flange system for existing installation", includes a system which includes a closet flange insert and at least one spacer to be positioned between the closet flange insert and an installed closet flange. The closet flange insert includes a toilet connecting flange which extends radially outwardly from a through pipe. The through pipe is sized to be inserted into a pipe section of a closet flange. Each spacer includes spaced apart first and second faces, and spaced apart inner and outer edges extending between the first and second faces. The inner edge defines an opening extending through the body, the opening sized to permit passage therethrough of the through pipe of the closet flange insert but not the toilet connecting flange of the closet flange insert.

Another prior development described in U.S. Patent Application Publication No. 2012/0240319, entitled "Toilet Flange Assembly With Cover", includes a toilet flange provided with a planar perimeter portion to assist the installer in accurately determining the distance to an adjacent wall as well as insuring the toilet fastening bolts are aligned parallel thereto. The toilet flange assembly includes a cover to store needed fastening elements while simultaneously preventing debris from entering the plumbing riser pipe. Additionally, a sleeve is provided that protects the threads of the toilet fastening bolts during construction and acts as an extendable flexible guide sleeve. The guide sleeve functionally extends the height of the toilet fastening bolt thereby assisting the toilet installer as a visual aid during installation but again fails to provide an adequate way to mark the floor around the toilet flange.

Another prior development described in U.S. Patent Application Publication No. 2013/0167292, entitled "Template for Closet Flange", includes templates, methods, and kits for installing closet flanges. The template can include a body having a sidewall and a bottom as well as a plurality of tabs connected to the body, with one or more of the tabs configured to delineate the location of a fastener hole in a closet flange but again fails to provide an adequate way to mark the floor around the toilet flange.

The prior developments above teaches a protective flange cover and method of use, a closet flange protector, a cover, spacer and plumbing installation assembly, a water closet fitting installation assembly, a drainage pipe covering kit for use during building or floor construction, a water closet flange seal, a closet flange system for existing installation, a toilet flange assembly with cover, and a template for closet flange, but fail wholly or inn part to enable relatively convenient and accurate marking of a hole cut-out location on the tile substantially corresponding to and providing clearance about the toilet flange.

Solutions have been long sought but prior developments have not taught or suggested any complete solutions, and solutions to these problems have long eluded those skilled in the art. Thus there remains a considerable need for devices and methods that can provide an adequate way to mark the floor around the toilet flange.

SUMMARY

Contemplated embodiments of the toilet flange template apparatus can include systems and methods for a toilet flange template apparatus comprising: a first arm having a first head and a first connecting member extending therefrom, the first head formed with a first centered boss extending therefrom; and a second arm having a second head and a second connecting member extending therefrom, the second arm being pivotally connected to the first arm, and the second arm configured to be parallel to the first arm when a tile is placed therebetween, the second head defining a perimeter edge corresponding to and providing circumferential clearance for an outer circumference of a toilet flange that the first centered boss is configured to mate with.

Accordingly it has been discovered that one or more embodiments described herein enables a first head on the toilet flange to be located even when a tile is placed over the toilet flange. It has further been discovered that one or more embodiments described herein, correspond to and provide circumferential clearance relative to the toilet flange for subsequent installation of the tile thereabout.

Other contemplated embodiments can include objects, features, aspects, and advantages in addition to or in place of those mentioned above. These objects, features, aspects, and advantages of the embodiments will become more apparent from the following detailed description, along with the accompanying drawings.

BRIEF DESCRIPTION OF THE DRAWINGS

The toilet flange template apparatus is illustrated in the figures of the accompanying drawings which are meant to be exemplary and not limiting, in which like reference numerals are intended to refer to like components, and in which.

DETAILED DESCRIPTION

Figure 1:
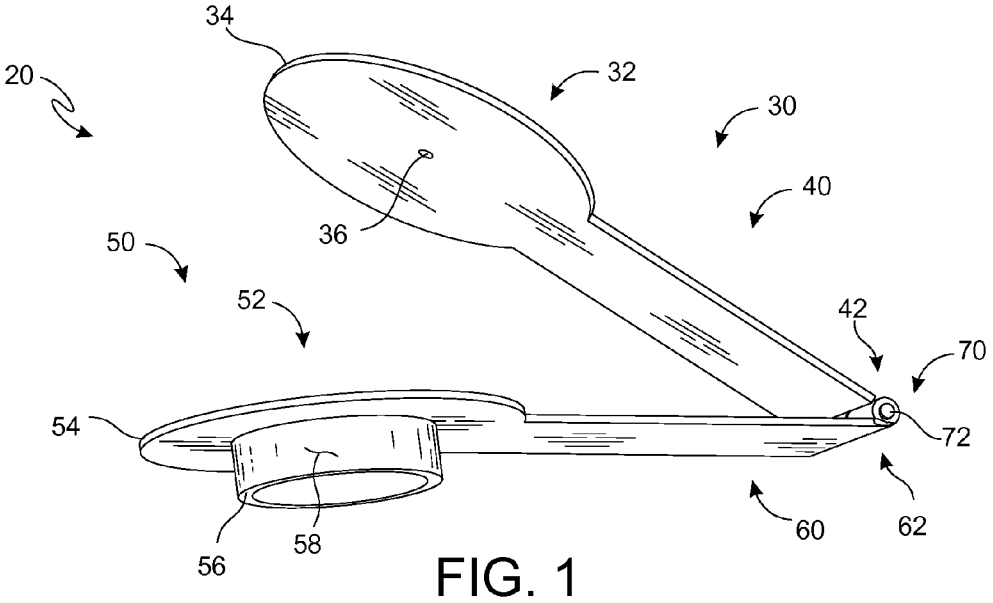
FIG. 1 is an isometric view of a toilet flange template apparatus in a first partially open configuration, in accordance with a first embodiment.

In the following description, reference is made to the accompanying drawings that form a part hereof, and in which are shown by way of illustration, embodiments in which the toilet flange template apparatus may be practiced. It is to be understood that other embodiments may be utilized and structural changes may be made without departing from the scope of the toilet flange template apparatus.

The toilet flange template apparatus system is described in sufficient detail to enable those skilled in the art to make and use the toilet flange template apparatus and provide numerous specific details to give a thorough understanding of the toilet flange template apparatus; however, it will be apparent that the toilet flange template apparatus may be practiced without these specific details.

In order to avoid obscuring the toilet flange template apparatus, some well-known system configurations are not disclosed in detail. Likewise, the drawings showing embodiments of the system are semi-diagrammatic and not to scale and, particularly, some of the dimensions are for the clarity of presentation and are shown greatly exaggerated in the drawing FIGs. Generally, the toilet flange template apparatus can be operated in any orientation.

Turning now to FIG. 1, therein is shown an isometric view of a toilet flange template apparatus 20 in a first partially open configuration, in accordance with a first embodiment. The apparatus 20 comprises, a first arm 30 and a second arm 50 connected at a hinge 70. While the toilet flange template apparatus is presented in the exemplary context of cutting flooring around a toilet flange, it will be appreciated that a similar device and method can be employed in other contexts where flooring or other surface covering is to be cut and positioned around a known and substantially fixed obstruction.

Figure 2:
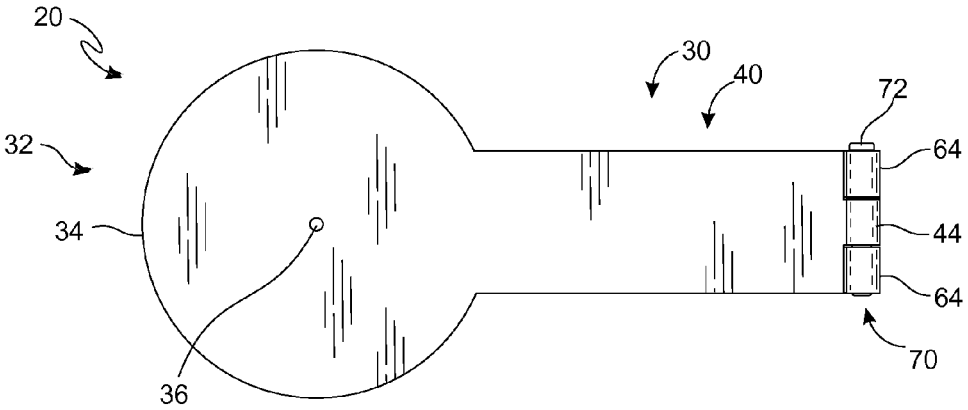
FIG. 2 is a top view of the toilet flange template apparatus of FIG. 1 in a second substantially closed configuration.
Figure 3:
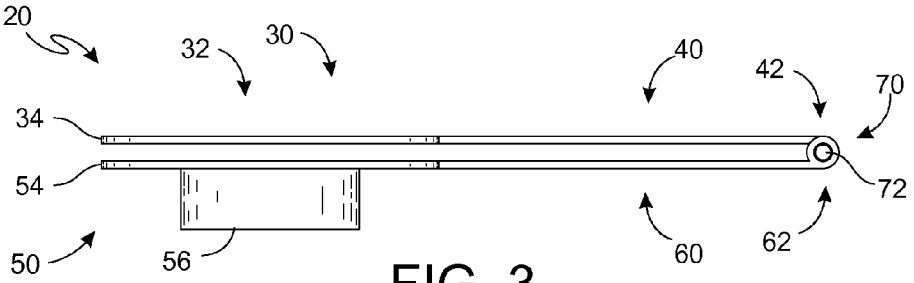
FIG. 3 is a side view of the toilet flange template apparatus of FIG. 2.

In further detail, with continued reference to FIG. 1 and now with reference to the top and side views of FIGS. 2 and 3, the toilet flange template apparatus 20 is again shown having two pivotally connected first and second arms 30, 50. The upper first arm 30 is formed having a substantially round first head 32 having extending substantially radially therefrom a first connecting member 40.

Figure 4:
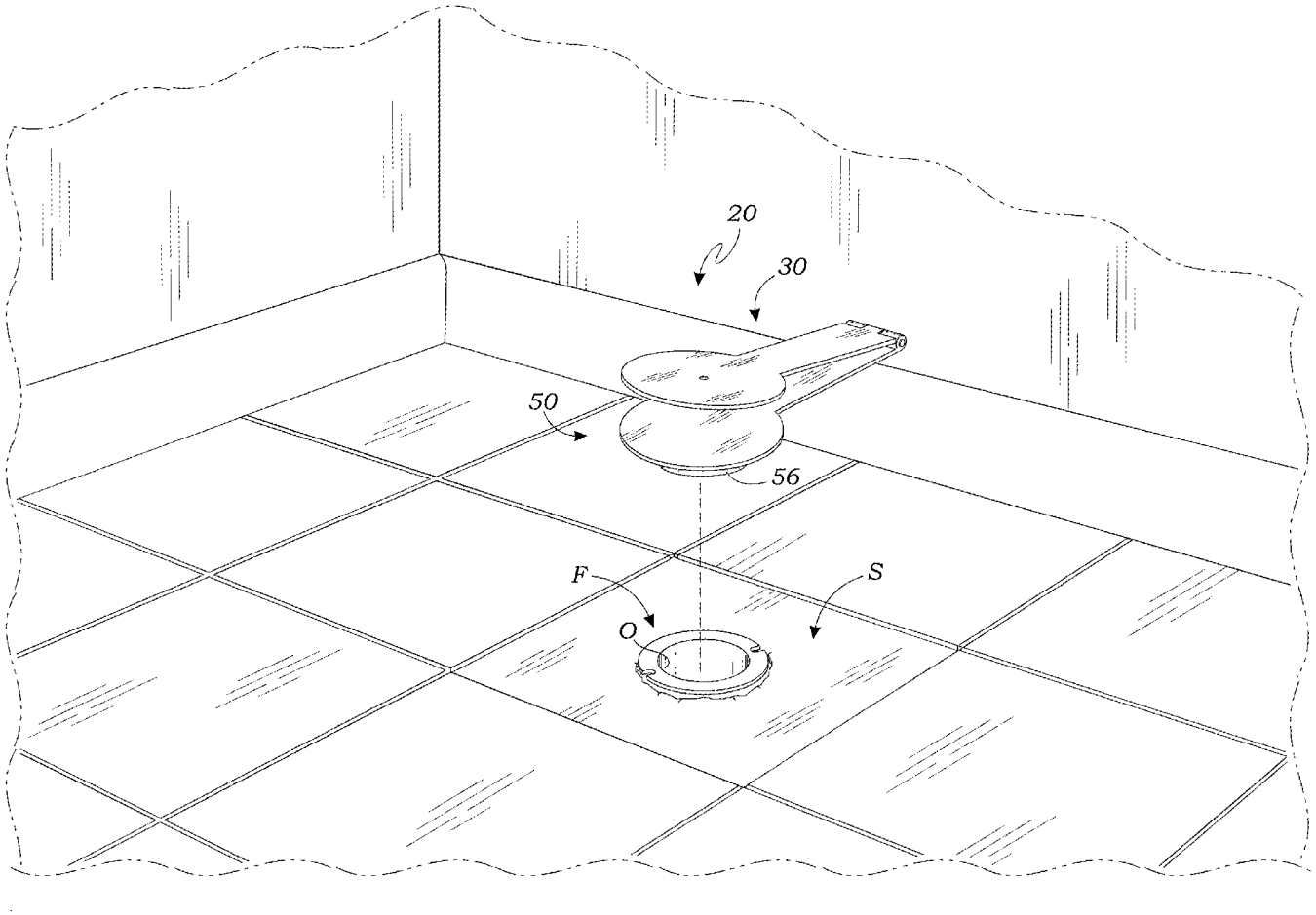
FIG. 4 is an isometric view of the toilet flange template apparatus of FIG. 1 after a mounting phase of operation.

The first head 32 thus defines a substantially round or arcuate first perimeter edge 34 and is in the exemplary embodiment configured so as to approximate though be somewhat larger than the typical toilet flange F (FIG. 4). Specifically, in the case of a conventional toilet flange F rated as a "4×3 flange," meaning that the connector at the top side of the flange F that actually connects to the toilet is a nominal four inches (4") in diameter while the bottom diameter of the pipe is three inches (3"), which flange thus has a nominal outside diameter on the top or exposed side of seven inches (7") at its widest point, the first head 32 has a nominal outside diameter as defined by the first perimeter edge 34 of seven and three-eighths (7⅜"), thus providing an approximate three-eighths inch (⅜") overlap or increased size of the first head 32 relative to the toilet flange F, or an approximate three-eighths inch (⅜") clearance between an opening or hole H cut in a tile T (FIGS. 10 and 11) based on the template's first head 32, assuming the cut is made substantially along the line marked based on the template first head 32 by a blade that is approximately three-sixteenths inch (3/16") thick, which operational sequence is shown and described further below in connection with FIGS. 4-11.

Preferably, the first head 32 will in the exemplary embodiment have a diameter of at least approximately three-sixteenth inch (3/16") greater than the largest outside dimension of the toilet flange F so as to provide at least a three-sixteenth inch (3/16") clearance about the flange. Once again, it will be appreciated that such dimensions and clearances are merely illustrative of features and aspects of the present disclosure and are non-limiting, as for example different toilet flange sizes or different or more generous clearances between the template first head 32 and the resulting hole H (FIGS. 10 and 11) relative to the toilet flange F (FIG. 4) are possible without departing from the spirit and scope of the disclosure.

Accordingly and relatedly, none of the drawings are to be taken as or assumed to be "to scale." As shown particularly in FIGS. 1 and 2, the first head 32 is further formed having a first center hole 36 formed therein so as to communicate therethrough, more about which will be said below in connection with the apparatus 20 in use. At the first distal end 42 of the first connecting member 40, or at the end of the connecting member 40 opposite the first head 32, there is formed a first hinge member 44, here configured as an annular walled formation substantially centered on the first distal end 42 of the connecting member 40 with a central opening therethrough (not shown).

Similarly, the lower second arm 50 is formed having a substantially round second head 52 having extending substantially radially therefrom a second connecting member 60. The first head 52 thus defines a substantially round or arcuate second perimeter edge 54 that in the exemplary embodiment is configured to approximate the first perimeter edge 34. However, those skilled in the art will appreciate, particularly in connection with the discussion of the apparatus 20 in use as shown in FIGS. 4-11, that while the second head 52 is thus shown as substantially mirroring the first head 32 that is not necessary, and the second head 52 can take a number of other configurations without departing from the spirit and scope of the disclosure.

At the second distal end 62 of the second connecting member 60, or at the end of the connecting member 60 opposite the second head 52, there is formed a second hinge member 64, here configured as a pair of offset annular walled formations spaced apart along the second distal end 62 of the connecting member 60 with a central opening therethrough (not shown), such that when the first and second arms 30, 50 are to be joined in a pivotal arrangement as shown, the first hinge member 44 of the first connecting member 40 is simply placed between the second hinge member 64 of the second connecting member 60 and a pin 72 passed through the first and second hinge members 44, 64 to form and define the functional hinge 70.

Relatedly, even the configurations of the respective first and second connecting members 40, 60 in terms of their sizes and being integral with the respective first and second heads 32, 52 and the first and second hinge members 44, 64 is exemplary and is to be understood as merely illustrative of features and aspects of the toilet flange template apparatus and non-limiting. With particular reference to FIGS. 1 and 3, the second arm 50 is also characterized in the exemplary embodiment by having a downwardly-extending substantially annular second centered boss 56 that is configured to enter and thus locate the apparatus 20 within the toilet flange F, more about which will again be said below in connection with the device in use as shown in FIGS. 4-11.

Staying with the exemplary "4×3 flange," the second centered boss 56 is formed in the illustrated embodiment such that the boss outer surface 58 has a nominal outside diameter of three and seven-eighths inches (3⅞") and a length of approximately two inches (2") so as to mate with the upper flange opening O. For the purposes of this application, mating means to fit securely within without wabeling more than about 10-50 degrees. In the present embodiment, the second centered boss 56 is described as mated with the upper flange opening O since the second centered boss 56 is 2" long with an outer diameter of 3⅞" while the upper flange opening has an inner diameter of 4" thus providing a secure fit.

In any event, it is preferable that the clearance between the outer surface 58 of the second centered boss 56 and any flange opening O range from approximately a sixteenth inch to a quarter inch (1/16"-¼") so as to properly locate the remainder of the apparatus 20 relative to the flange F but allow for some clearance for ease of insertion and removal of the boss 56 and to account for variations among nominal flange sizes in the industry. Relatedly, it is preferable in the exemplary embodiment that the length of the second centered boss 56 be at least approximately one inch (1") in order to attain an adequate registration within the flange opening O.

With particular reference now to the side view of the exemplary toilet flange template apparatus 20 according to the disclosure of FIG. 3, it is shown that the overall lengths of the respective first and second arms 30, 50 are substantially equivalent as best appreciated while viewing the device in its substantially closed configuration.

It can be seen that in such configuration the first and second arms 30, 50 are further substantially adjacent and parallel. In the exemplary embodiment and context of floor tiles, such tiles T (FIG. 4) having a nominal thickness of approximately three-eighths of an inch (⅜"), a corresponding approximately three-eighths of an inch (⅜") gap is thereby formed or left between the respective first and second arms 30, 50 when the apparatus 20 is in its substantially closed configuration, whereby a tile T positioned between the arms 30, 50, as shown particularly in FIG. 7, will have a substantially net fit arrangement, or result in both the first and second arms 30, 50 being substantially parallel and adjacent to opposite sides of the tile T.

Continuing with an exemplary tile T, where such is up to a nominal twenty-one inch (21") square, it will be appreciated that no matter where the tile to be cut is positioned relative to the apparatus 20 and the toilet flange F and the surrounding tiles, assuming free rotation of the apparatus 20 within the flange F, if the apparatus 20 is to accommodate such a tile, the distance from the hinge 70 to particularly the first head 32 should be at least approximately seven inches (7") so as to position the head 32 virtually anywhere over the tile T, even at substantially the geometric center of the tile T. In the exemplary embodiment the length of the first and second connecting members 40, 60 is approximately eight inches (8"), yielding an overall length of the apparatus 20 in its substantially closed configuration of approximately fifteen and a half inches (15½") and thus putting the center of the first head 32, or the location of the first center hole 36, approximately eleven and a half inches (11½") from the hinge 70, or long enough to comfortably reach the center of even a 21-inch tile.

Once more, those skilled in the art will appreciate that all such sizes, shapes, and configurations of the toilet flange template apparatus and its components are merely illustrative of the features and aspects of the present toilet flange template apparatus, such that numerous alternative configurations are possible without departing from the spirit and scope of the toilet flange template apparatus. In the exemplary embodiment of the apparatus 20 and assuming up to twenty-one inch (21") tiles are to be accommodated, it is preferable that the overall length of the apparatus 20 be at least fourteen inches (14"), assuming a roughly seven inch (7") first connecting member 40 length and a roughly seven inch (7") diameter first head 32, again, so as to accommodate any such tile and any location of the cut thereon corresponding to the flange location relative to where the tile or other flooring is to be installed.

Again, it will be appreciated by those skilled in the art that the apparatus 20 can easily be scaled up or down depending on the size of tile to be accommodated and other factors. Notably, whatever the case, it is important, as will be appreciated further based on the below discussion of the apparatus in use, that the center of the upper first head 32, and particularly the first center hole 36, be substantially centered over the lower second head 52, and particularly the second centered boss 56, no matter the sizes or configurations of the respective heads 32, 52 or connecting members 40, 60 when the apparatus 20 is in its substantially closed configuration as shown in FIG. 3.

Briefly, in terms of the construction of the exemplary toilet flange template apparatus 20, in one illustrative embodiment each component, namely the first and second arms 30, 50, may be of a unitary construction such as formed of a plastic such as ABS as through a molding process. In such a case, the arms 30, 50 may each be formed so as to be approximately one eighth of an inch (⅛") or perhaps slightly thicker.

Regarding the first center hole 36 formed in the first head 32 and the second centered boss 56 formed on the second head 52, such features may be formed simultaneously with the respective first and second arms 30, 50 or in secondary operations, such as by drilling the center hole 36 or separately molding or otherwise forming the second centered boss 56 and then installing the boss 56 on the second head 52 as through solvent bonding, ultrasonic welding, or any other technique now known or later developed. More generally, those skilled in the art will appreciate that any appropriate material and method of fabrication or construction now known or later developed may be employed in forming the apparatus 20 according to aspects of the present disclosure without departing from its spirit and scope, such that the present configuration, including size and shape and material, is to be understood as expressly non-limiting and merely illustrative.

To complete the exemplary assembly, once the first and second arms 30, 50 are formed, the pin 72 is simply inserted through the formed first and second hinge members 44, 64 so as to form the hinge 70 and thereby pivotally link the first and second arms 30, 50. Again, while a pinned hinge 70 is shown and described, any other such means of linking the first and second arms 30, 50 is possible without departing from the spirit and scope of the toilet flange template apparatus.

Turning now to FIGS. 4-11, in use in the exemplary context of installing tile in a bathroom or the like, the toilet flange template apparatus 20 according to aspects of the disclosure is to be employed in relatively efficiently, conveniently, and accurately determining a cut needed in the selected flooring material so as to then position and install such flooring around the toilet flange or the like. As shown in FIG. 4, there remains an opening in the tile flooring about the toilet flange F in which a tile T (FIG. 6) is to be installed on the subfloor S.

As a first step, as shown in exploded fashion, the apparatus 20 is positioned over the flange F with the second centered boss 56 oriented downwardly substantially over the toilet flange F so that the boss 56 may be inserted particularly within the opening O of the flange F. At this point the position of the first arm 30 relative to the second arm 50 is effectively irrelevant.

Figure 5:
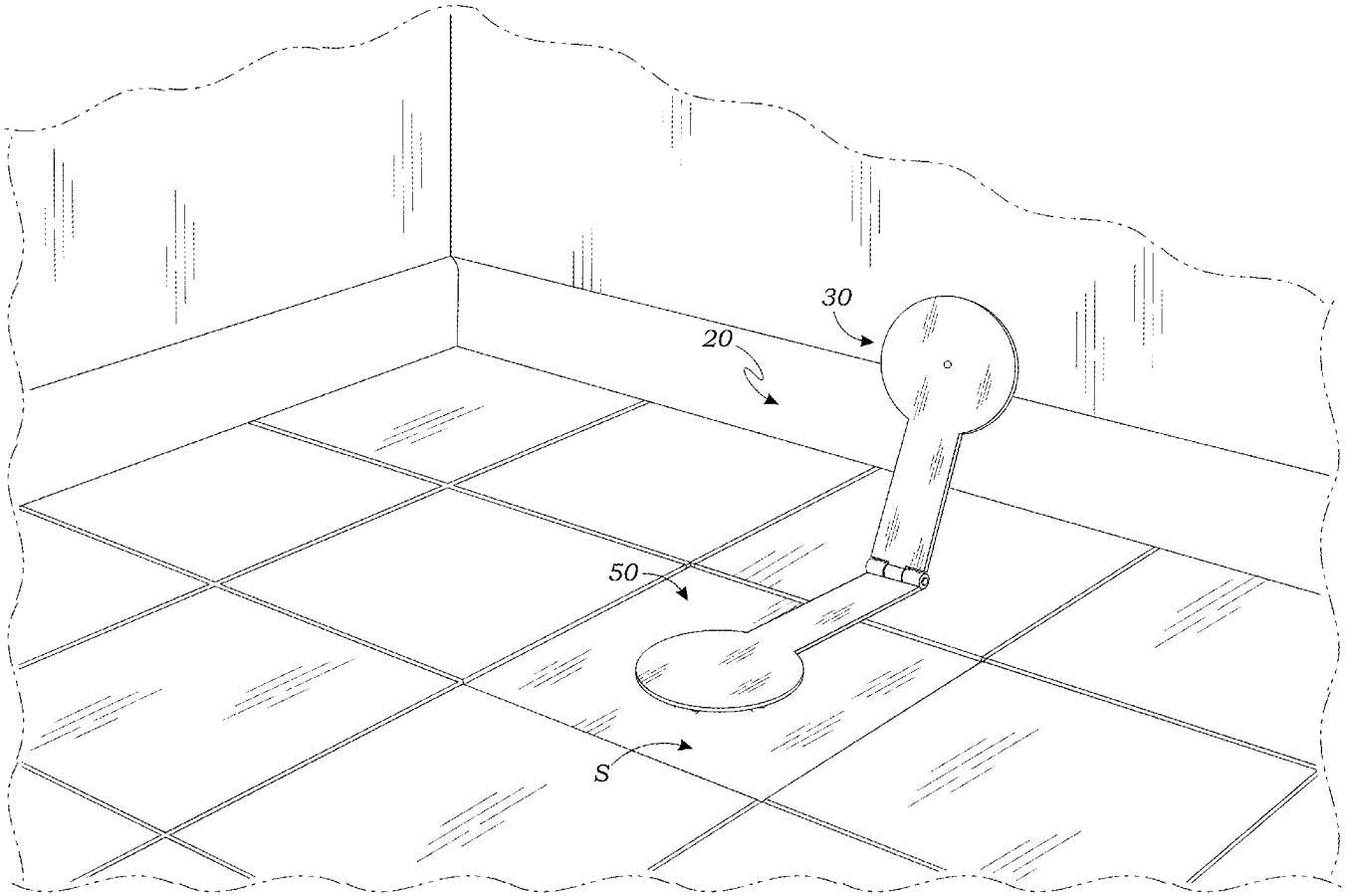
FIG. 5 is an isometric view of the toilet flange template apparatus of FIG. 1 after an opening phase of operation.

Next, as shown in FIG. 5, the apparatus 20 is now positioned over the toilet flange F (FIG. 4) with the second centered boss 56 located within the opening O (FIG. 4). It will be appreciated that the second arm 50, and particularly the second head 52 serves a separate function of blocking the toilet flange opening O (FIG. 4) so as to substantially prevent unwanted debris from entering therein during the flooring installation.

Figure 6:
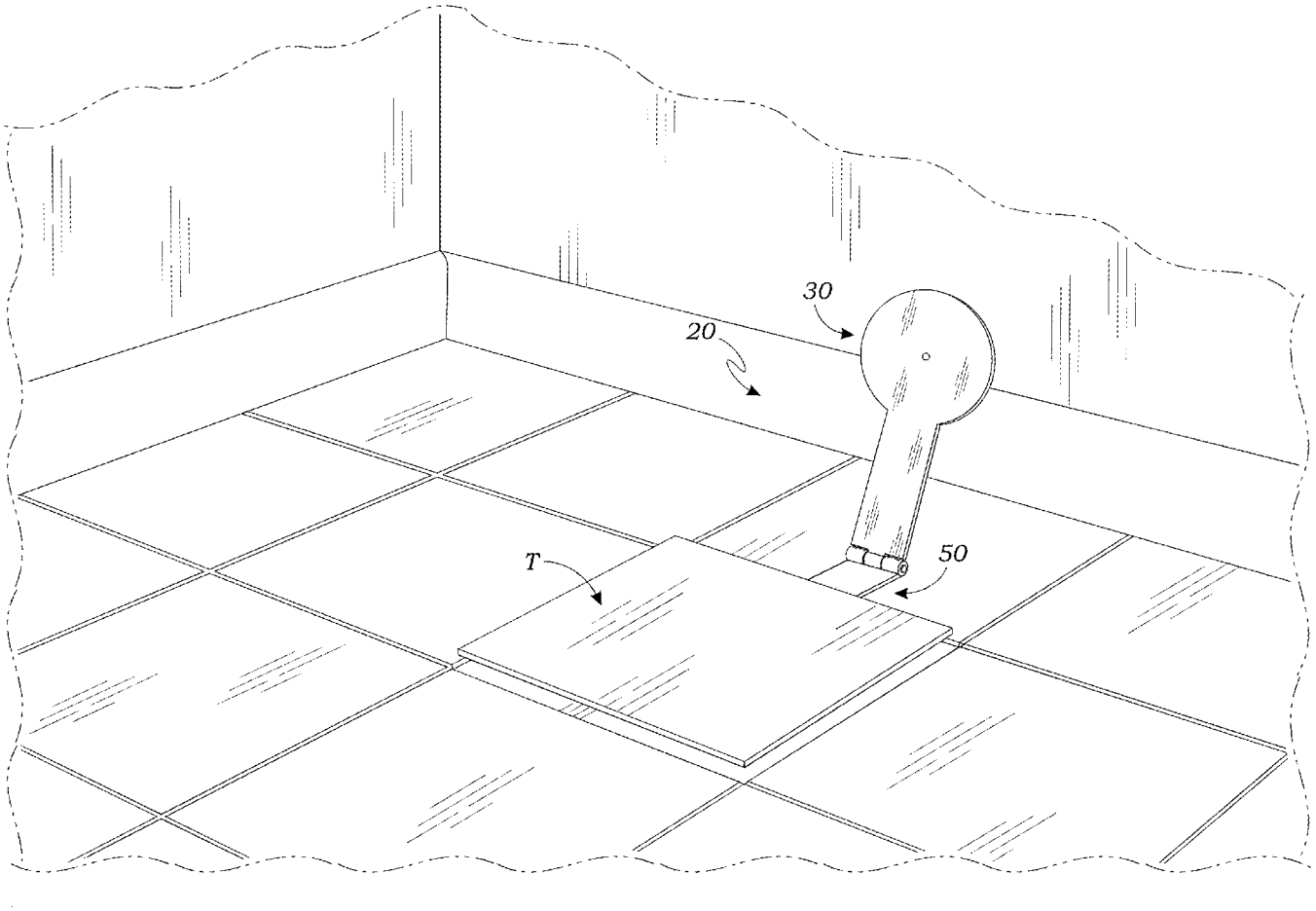
FIG. 6 is an isometric view of the toilet flange template apparatus of FIG. 1 after a loading phase of operation.

The first arm 30 is shown as now being pivoted up and away from the second arm 50 that lies substantially parallel to the subfloor S, again, with the second centered boss 56 located within the opening O of the flange F (FIG. 4), so as to be in a position to receive a tile T (FIG. 6) therebetween, or laid on the second arm 50 as shown in FIG. 6. Particularly, as shown in FIG. 6, the tile T that is ultimately to be installed on the subfloor S about the toilet flange F (FIG. 4) is placed immediately over and substantially adjacent the lower second arm 50 of the apparatus 20 and positioned thereon in substantially the location the tile T is to be installed relative to the other flooring.

Figure 7:
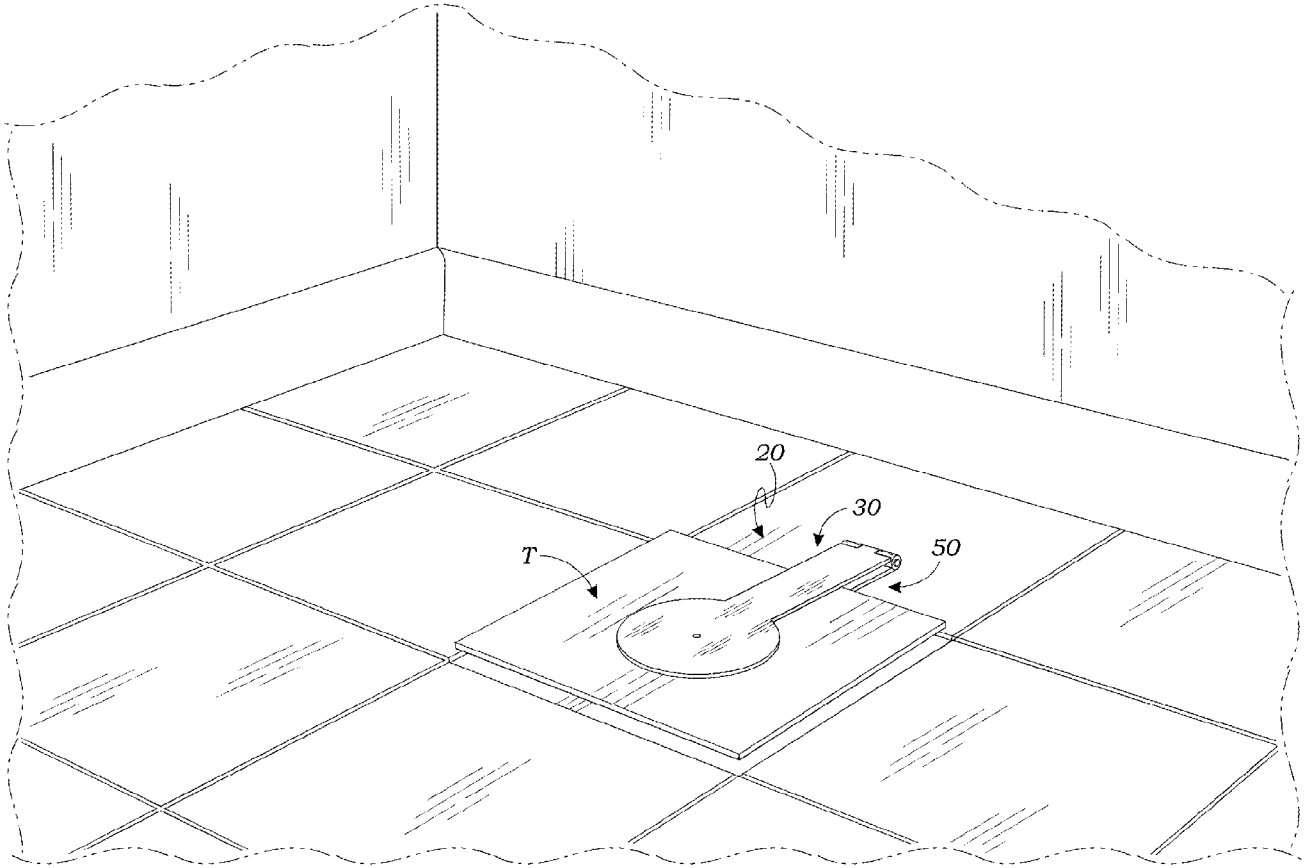
FIG. 7 is an isometric view of the toilet flange template apparatus of FIG. 1 after a closing phase of operation.

In such position, as shown in FIG. 7, the next step is to pivot the first arm 30 back down so as to be immediately over and substantially adjacent the tile T, which in the exemplary embodiment is to place the apparatus 20 substantially in the closed configuration as shown in FIG. 3 with the tile T effectively sandwiched between the first and second arms 30, 50, again positioned where desired over the toilet flange F (FIG. 4). Those skilled in the art will appreciate, however, that rather than pivoting the first arm 30 up and away as in FIGS. 5 and 6 and then back down as in FIG. 7, it would effectively be just as easy and perhaps even preferable in some contexts to simply slip the tile T in between the first and second arms 30, 50 even while in a substantially closed configuration of the apparatus 20 as shown in FIGS. 3 and 7.

Figure 8:
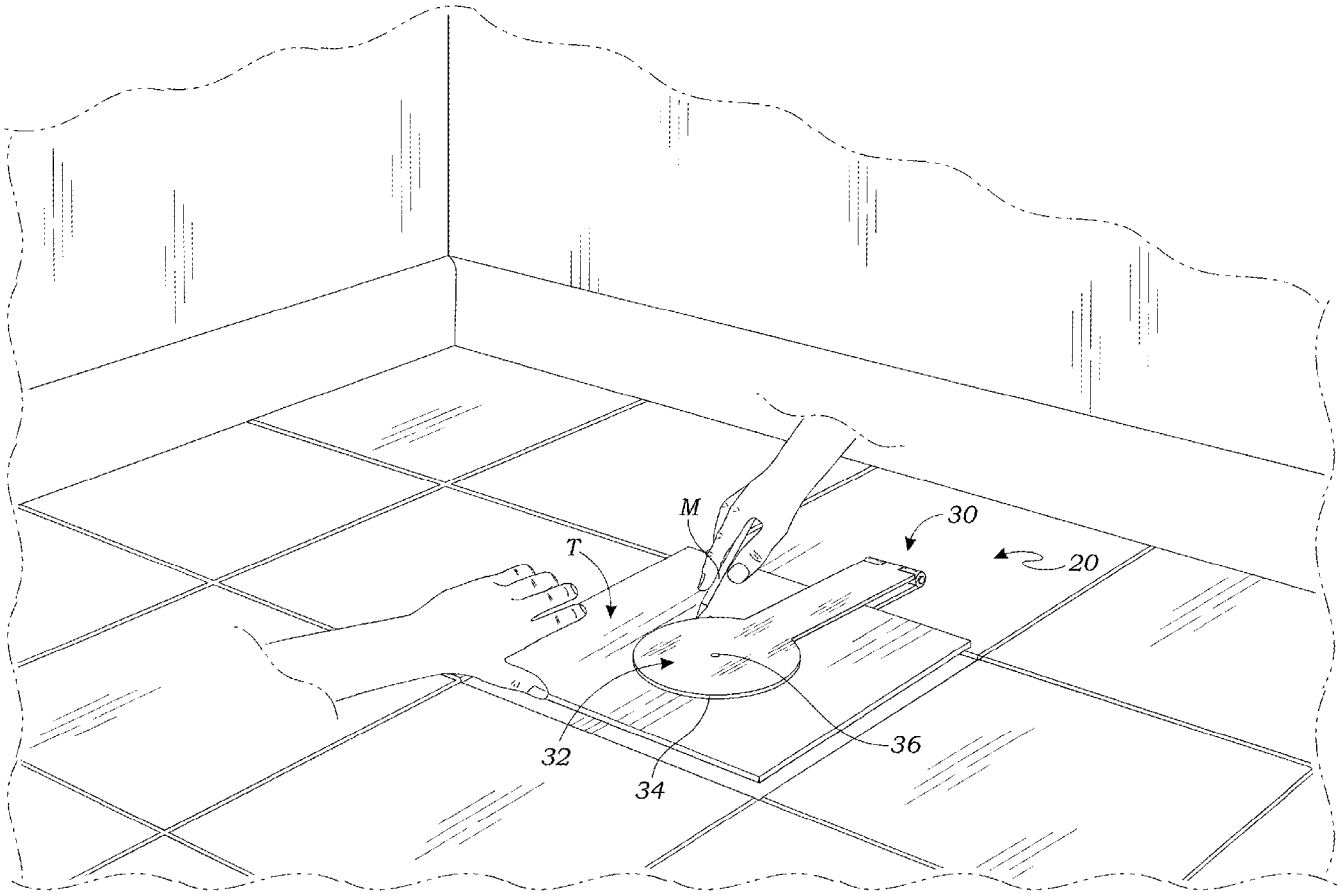
FIG. 8 is an isometric view of the toilet flange template apparatus of FIG. 1 in a tracing phase of operation.

In any event, once the tile T is thus positioned within the apparatus 20, now with reference to FIG. 8, a writing implement, scribe, or other such tool M for marking the surface of the tile T may be used to trace the perimeter edge 34 of the head 32 of the upper or exposed first arm 30. It will be appreciated by those skilled in the art that in so doing, due to the location of the apparatus 20, and thus the first arm 30, relative to the toilet flange F (FIG. 4) based on the engagement of the downwardly-extending second centered boss 56 of the second arm 50 within the flange opening O (FIG. 4), the arcuate or curved line L (FIG. 9) resulting on the surface of the tile T corresponds to the clearance cut to be made in the tile T substantially corresponding to and clearing the flange F. It will be further appreciated that in this context it is effectively irrelevant the size and shape of the second head 52 (FIG. 1) since the tile T is only being marked and will later be cut when removed from the apparatus 20.

In other contexts, though, the flooring, such as linoleum or the like, might be cut in place employing the apparatus 20 as a cutting template, in which case the second head 52 approximating the first head 32 is advantageous. In any event, it is desirable that the size and shape of the second head 52 at least accommodate the second center bore 56 and also allow for a flush seating over the flange F (FIG. 4), which again has the further advantage of helping to prevent unwanted debris from entering the opening O of the toilet flange F (FIG. 4).

Figure 9:
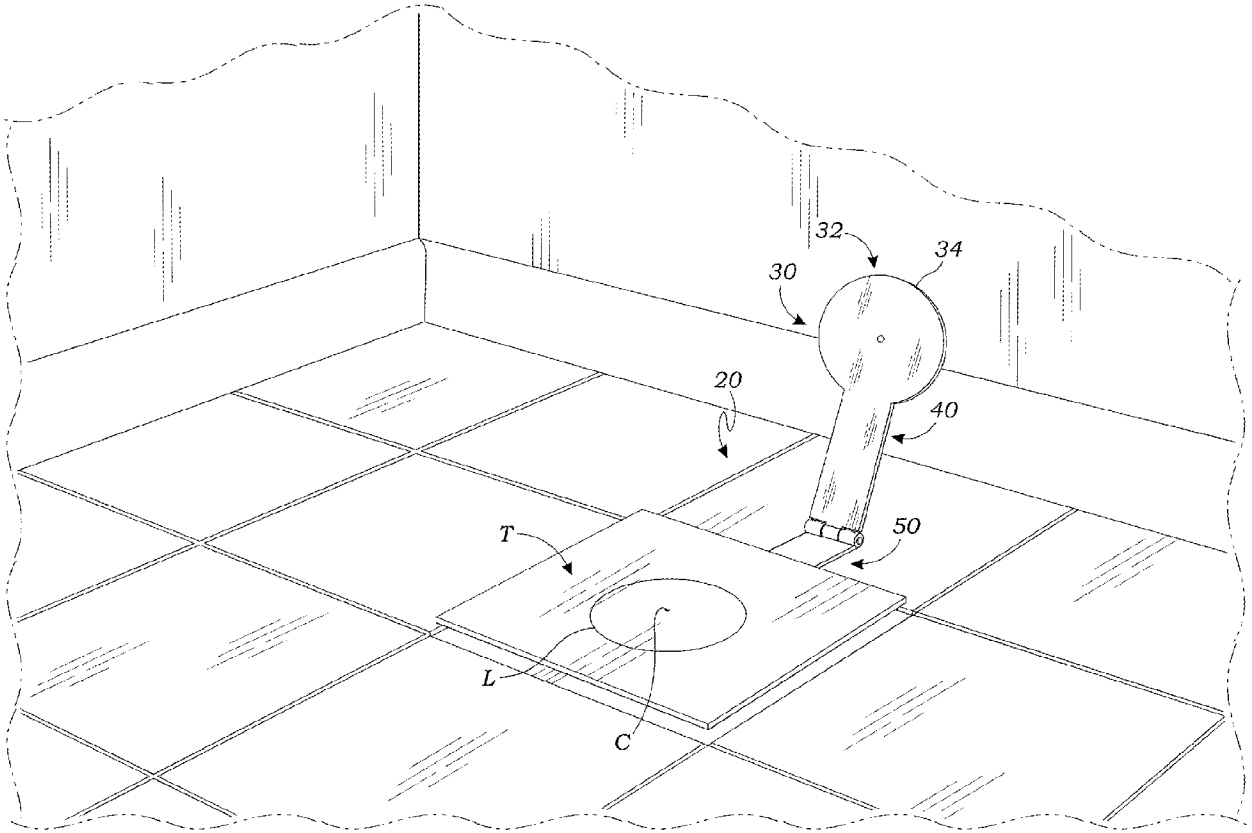
FIG. 9 is an isometric view of the toilet flange template apparatus of FIG. 1 after a tracing phase of operation.

Thus, it is preferable in the exemplary embodiment that the diameter of the second head 52 be at least that of the toilet flange opening O, which it will be appreciated would result in the second head 52 being smaller than the first head 32 rather than the two being the same size as shown in FIGS. 1-3. In FIG. 9, the first arm 30 is shown as again having been pivoted up and away from the tile T and the second arm 50, with the line L that was marked previously on the surface of the tile T now being visible.

Those skilled in the art will appreciate that while the line L is shown as being a complete circle, such could not be traced in its entirety about the perimeter edge 34 of the first head 32 in the exemplary embodiment due to the first connecting member 40. However, in an alternative embodiment (not shown), the first connecting member 40 could be joined more centrally to the first head 32 and bent upwardly at its middle section to form a handle of sorts and thereby provide clearance about substantially the entire perimeter of the first head 32.

Or, utilizing the first center hole 36 formed in the first head 32, the marking tool M (FIG. 8) could be employed with the apparatus 20 in the closed position over the tile T as shown in FIG. 7 to also mark the center location C of the hole H (FIG. 10) to be cut; then, when the first arm 30 is pivoted up and away, a compass or other such tool (not shown) could be used to complete the circular line L by taking advantage of the marked center location C. Or, the small portion of the circular line L not directly traced around the perimeter edge 34 of the first head 32 could simply be completed "by hand" after the first arm 30 is pivoted up and out of the way or the tile T is otherwise removed from the apparatus 20.

Figure 10:
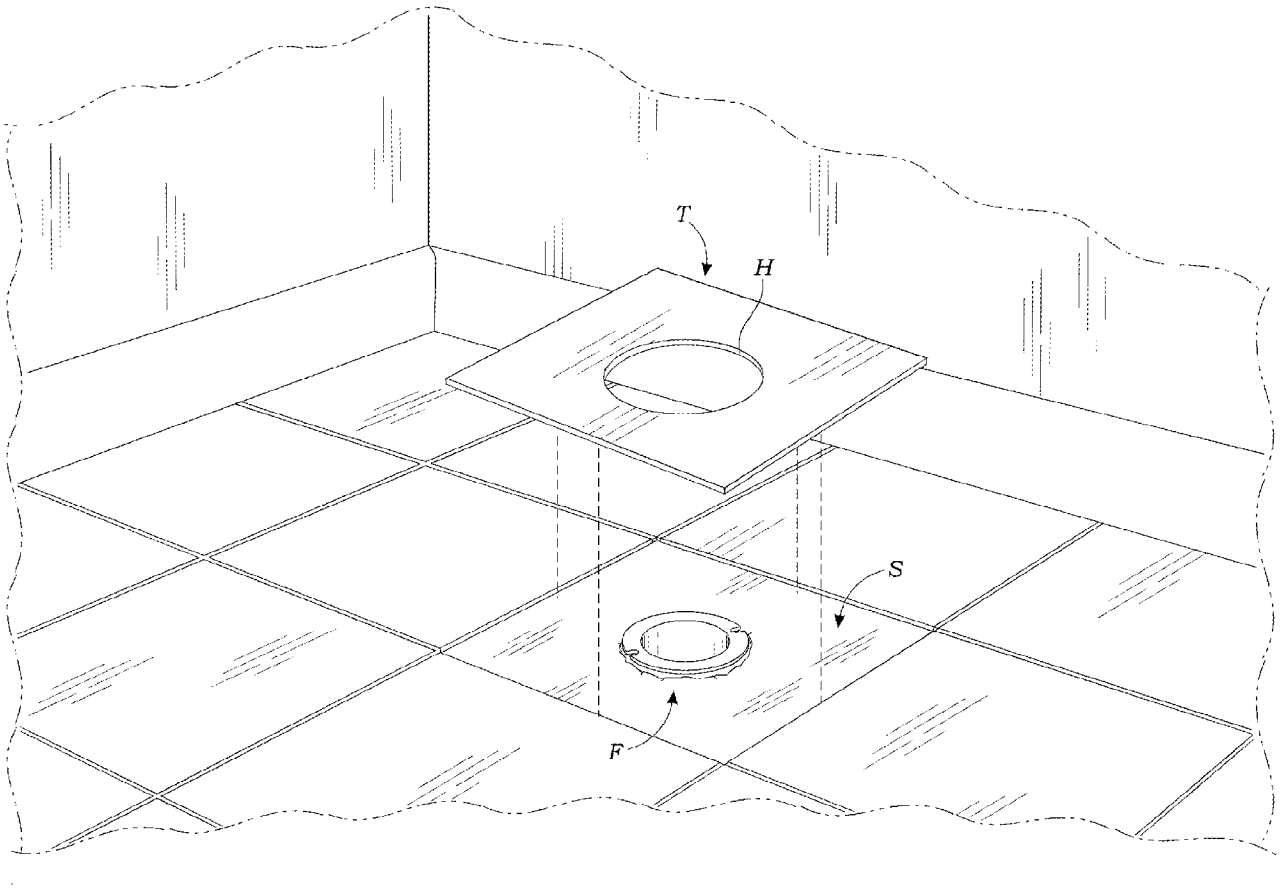
FIG. 10 is an isometric view of the cut tile in an installation step.
Figure 11:
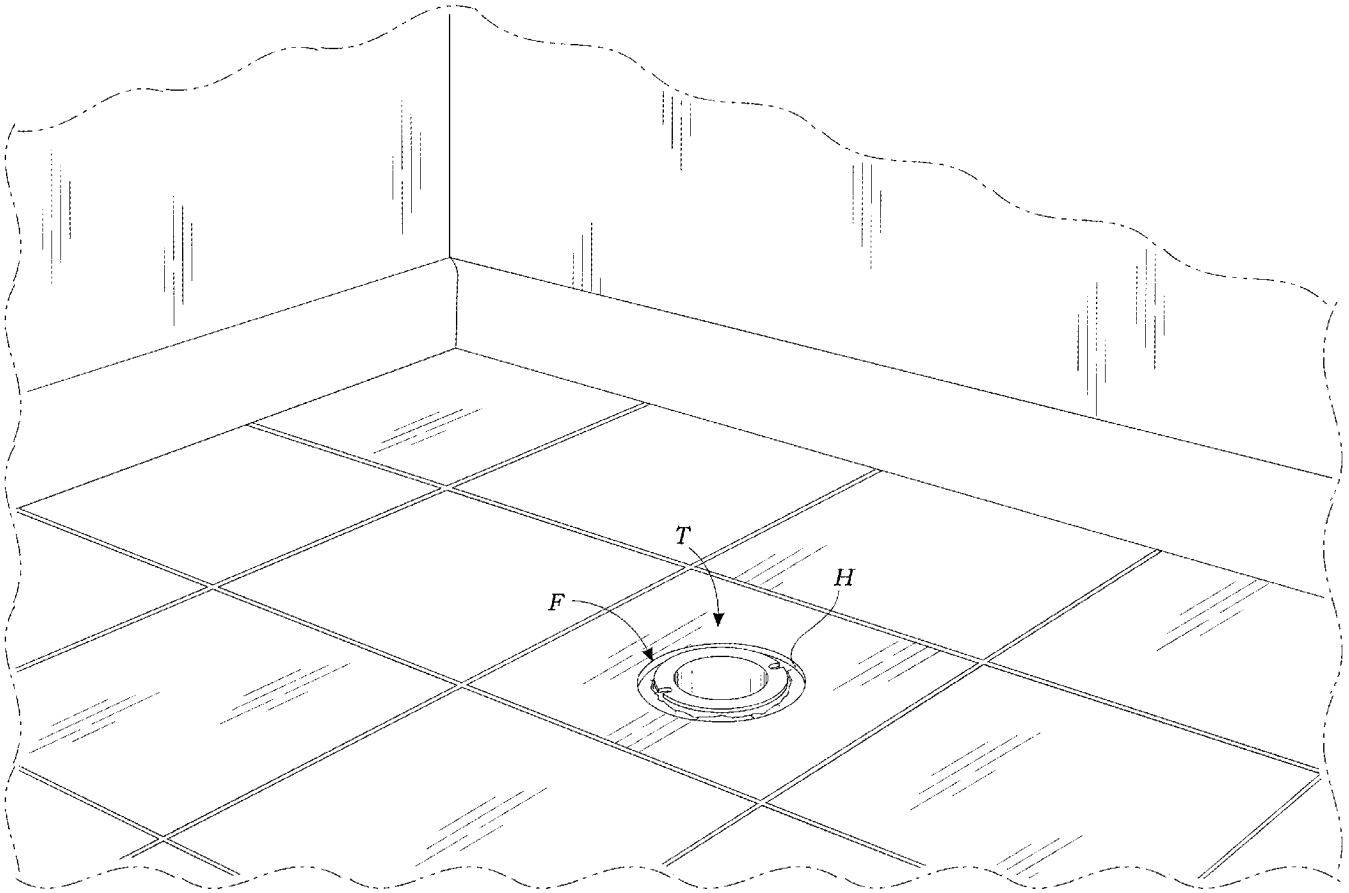
FIG. 11 is an isometric view of the cut tile after the installation step of FIG. 10.

Again, it will be appreciated that the tile T can be inserted in or removed from the apparatus 20 with or without pivoting, in whole or in part, the first arm 30 relative to the second arm 50. Finally, with reference to FIGS. 10 and 11 showing what is from that point the conventional approach to installing a properly cut tile T, the tile T with the hole H cut therein using any appropriate equipment, tool, or technique now known or later developed as substantially corresponding to the line L (FIG. 9) as marked on the tile T as above-described is first positioned over the location the tile T is to be installed and is then in fact installed about the toilet flange F as shown.

Once again, those skilled in the art will appreciate that the toilet flange template apparatus 20 according to aspects of the present disclosure substantially facilitated convenient and effective marking of the proper size and location of the hole H relative to the toilet flange F, rendering the device functionally useful and beneficial.

Figure 12:
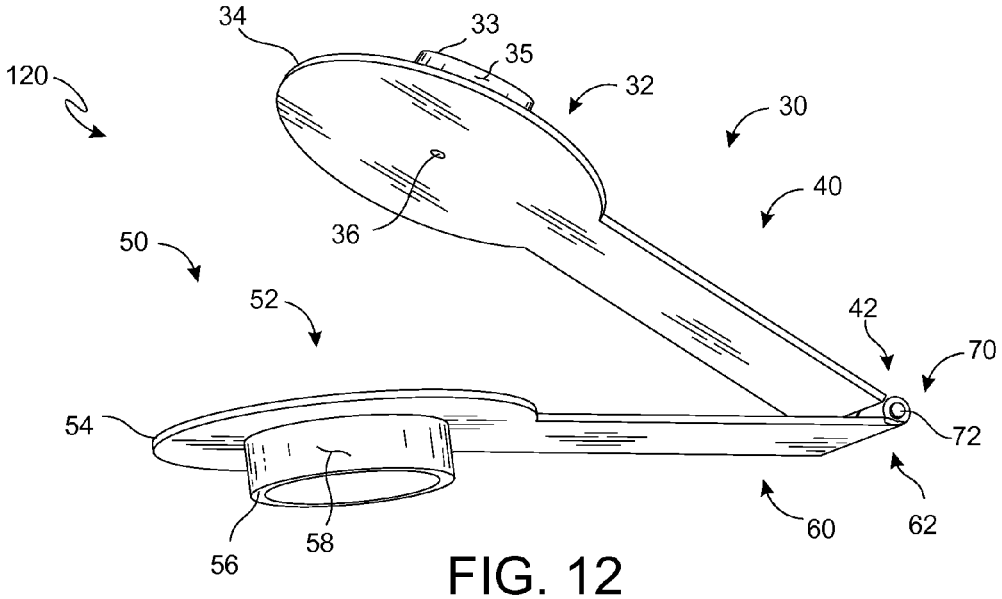
FIG. 12 is an isometric view of a toilet flange template apparatus in a first partially open configuration, in accordance with a second embodiment.

Turning now to FIG. 12, therein is shown an isometric view of a toilet flange template apparatus 120 in a first partially open configuration, in accordance with a second embodiment. The apparatus 120 comprises, a first arm 30 and a second arm 50 connected at a hinge 70. While the toilet flange template apparatus is presented in the exemplary context of cutting flooring around a toilet flange, it will be appreciated that a similar device and method can be employed in other contexts where flooring or other surface covering is to be cut and positioned around a known and substantially fixed obstruction.

Figure 13:
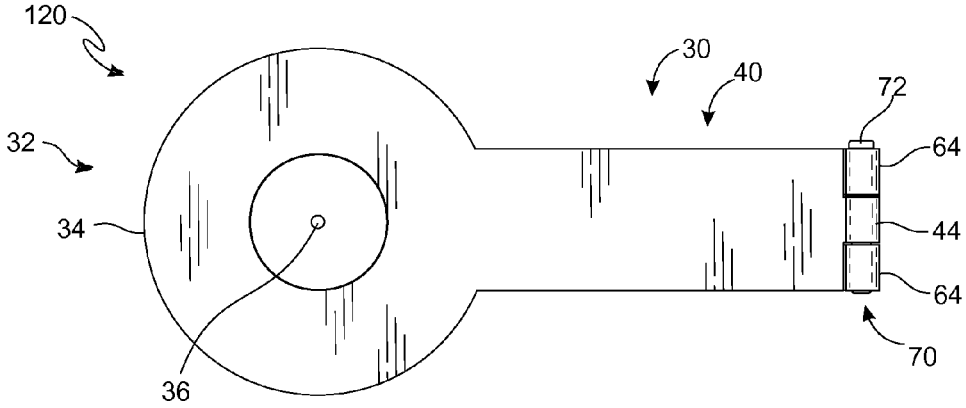
FIG. 13 is a top view of the toilet flange template apparatus of FIG. 12 in a second substantially closed configuration.
Figure 14:
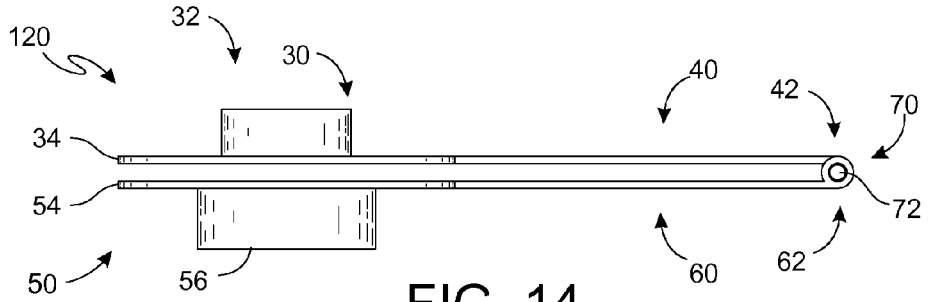
FIG. 14 is a side view of the toilet flange template apparatus of FIG. 13.

In further detail, with continued reference to FIG. 12 and now with reference to the top and side views of FIGS. 13 and 14, respectively, the toilet flange template apparatus 120 is again shown having the two pivotally connected first and second arms 30, 50. The upper first arm 30 is formed having a substantially round first head 32 having extending substantially radially therefrom a first connecting member 40 while the lower second arm 50 is formed having a substantially round second head 52 having extending substantially radially therefrom a second connecting member 60.

The first head 32 is depicted having an upwardly-extending substantially annular first centered boss 33 that is configured to enter and thus locate the apparatus 120 within the toilet flange F, similar to the annular second centered boss 56 as described with regard to FIGS. 4-11.

The first head 32 and the second head 52 thus define a substantially round or arcuate first perimeter edge 34 and 54, respectively. The first centered boss 33 is configured so as to approximate though a typical toilet flange F similar to that depicted in FIG. 4 but having a 3 inch diameter. It is contemplated that the first centered boss 33 can have a diameter of 2 and ⅞ inches to fit securely within the 3 inch diameter of the typical toilet flange. The second head 52 has a nominal outside diameter as defined by the first perimeter edge 54 of seven and three-eighths (7⅜"), thus providing an approximate three-eighths inch (⅜") overlap or increased size of the first head 32 relative to the toilet flange F, or an approximate three-eighths inch (⅜") clearance between an opening or hole H cut in a tile T (FIGS. 10 and 11) based on the template's second head 52, assuming the cut is made substantially along the line marked based on the template second head 52 by a blade that is approximately three-sixteenths inch (3/16") thick, similar to the operational sequence shown and described in FIGS. 4-11.

The second centered boss 56 is configured to approximate though be somewhat larger than the typical toilet flange F (FIG. 4). Specifically, in the case of a conventional toilet flange F rated as a "4×3 flange," meaning that the connector at the top side of the flange F that actually connects to the toilet is a nominal four inches (4") in diameter while the bottom diameter of the pipe is three inches (3"), which flange thus has a nominal outside diameter on the top or exposed side of seven inches (7") at its widest point, the first head 32 has a nominal outside diameter as defined by the first perimeter edge 34 of seven and three-eighths (7⅜"), thus providing an approximate three-eighths inch (⅜") overlap or increased size of the first head 32 relative to the toilet flange F, or an approximate three-eighths inch (⅜") clearance between an opening or hole H cut in a tile T (FIGS. 10 and 11) based on the template's first head 32, assuming the cut is made substantially along the line marked based on the template first head 32 by a blade that is approximately three-sixteenths inch (3/16") thick, which operational sequence is shown and described further above in connection with FIGS. 4-11.

Conversely the second head 52 can be configured to provide an approximate three-eighths inch (⅜") overlap with a typical sized toilet flange that the first centered boss 33 is mated to. Because the first centered boss 33 is configured to mate to a smaller flange than the second centered boss 56, the second head 52 can be smaller to provide only a three-eighths of an inch overlap cutout pattern to a tile that will be placed over the flange that the first centered boss 33 is mated to.

Preferably, the first head 32 and the second head 52 will have a diameter of at least approximately three-sixteenth inch (3/16") greater than the largest outside dimension of the toilet flange F so as to provide at least a three-sixteenth inch (3/16") clearance about the flange. Once again, it will be appreciated that such dimensions and clearances are merely illustrative of features and aspects of the present disclosure and are non-limiting, as for example different toilet flange sizes or different or more generous clearances between the template first head 32 and the resulting hole H (FIGS. 10 and 11) relative to the toilet flange F (FIG. 4) are possible without departing from the spirit and scope of the toilet flange template apparatus 20.

As shown particularly in FIGS. 12 and 13, the first head 32 is further formed having a first center hole 36 formed therein so as to communicate therethrough, more about which will be said below in connection with the apparatus 120 in use. A complementary similarly shaped, sized, and positioned second center hole (not shown) can be formed on the second head 52 so as to communicate therethrough, more about which will be said below in connection with the apparatus 120 in use. At the first distal end 42 of the first connecting member 40, or at the end of the connecting member 40 opposite the first head 32, there is formed a first hinge member 44, here configured as an annular walled formation substantially centered on the first distal end 42 of the connecting member 40 with a central opening therethrough (not shown).

The first head 52 thus defines a substantially round or arcuate second perimeter edge 54 that in the exemplary embodiment is configured to approximate the first perimeter edge 34. However, those skilled in the art will appreciate, particularly in connection with the discussion of the apparatus 120 in use as shown in FIGS. 4-11, that while the second head 52 is thus shown as substantially mirroring the first head 32 that is not necessary and it is contemplated that the second head 52 will have a diameter that corresponds to the size of hole needed for the flange fitted by the first centered boss 33 while the first head 32 will have a diameter that corresponds to the size of hole needed for the flange fitted by the second centered boss 56.

At the second distal end 62 of the second connecting member 60, or at the end of the connecting member 60 opposite the second head 52, there is formed a second hinge member 64, here configured as a pair of offset annular walled formations spaced apart along the second distal end 62 of the connecting member 60 with a central opening therethrough (not shown), such that when the first and second arms 30, 50 are to be joined in a pivotal arrangement as shown, the first hinge member 44 of the first connecting member 40 is simply placed between the second hinge member 64 of the second connecting member 60 and a pin 72 passed through the first and second hinge members 44, 64 to form and define the functional hinge 70.

Relatedly, even the configurations of the respective first and second connecting members 40, 60 in terms of their sizes and being integral with the respective first and second heads 32, 52 and the first and second hinge members 44, 64 is exemplary and is to be understood as merely illustrative of features and aspects of the present toilet flange template apparatus 20 and non-limiting. With particular reference to FIGS. 12 and 14, the first centered boss 33 and the second centered boss 56 can be configured to enter and thus locate the apparatus 120 within the toilet flange F, as described above with regard to FIGS. 4-11. It is contemplated that the apparatus 120 can provide additional benefits by allowing the apparatus 120 to be used on multiple sizes of toilet flanges F by flipping the apparatus 120 over.

It is contemplated that the second centered boss 56 is formed with a boss outer surface 58 having a nominal outside diameter of three and seven-eighths inches (3⅞") and a length of approximately two inches (2") so as to substantially fit within the upper flange opening O again having a nominal inside diameter of four inches (4"). Similarly it is contemplated that the first centered boss 33 is formed with a boss outer surface 35 having a nominal outside diameter of two and seven-eighths inches (2⅞") and a length of approximately one inch (1") so as to substantially fit within the upper flange opening O having a nominal inside diameter of three inches (3").

In any event, it is preferable that the clearance between the outer surface 58 of the second centered boss 56 or the outer surface 35 of the first centered boss 33 and any flange opening O range from approximately a sixteenth inch to a quarter inch (1/16"-¼") so as to properly locate the remainder of the apparatus 120 relative to the flange F but allow for some clearance for ease of insertion and removal of the boss 56 and 33 and to account for variations among nominal flange sizes in the industry. Relatedly, it is preferable in the exemplary embodiment that the length of the first and second centered boss 33/56 be at least approximately one inch (1") in order to attain an adequate registration within the flange opening O.

With particular reference now to the side view of the exemplary toilet flange template apparatus 120 according to aspects of the toilet flange template apparatus 120 shown in FIG. 14, it is shown that the overall lengths of the respective first and second arms 30, 50 are substantially equivalent as best appreciated while viewing the device in its substantially closed configuration.

It can be seen that in such configuration the first and second arms 30, 50 are further substantially adjacent and parallel. In the exemplary embodiment and context of floor tiles, such tiles T (FIG. 4) having a nominal thickness of approximately three-eighths of an inch (⅜"), a corresponding approximately three-eighths of an inch (⅜") gap is thereby formed or left between the respective first and second arms 30, 50 when the apparatus 120 is in its substantially closed configuration, whereby a tile T positioned between the arms 30, 50, as shown for example in FIG. 7, will have a substantially net fit arrangement, or result in both the first and second arms 30, 50 being substantially parallel and adjacent to opposite sides of the tile T.

Continuing with an exemplary tile T, where such is up to a nominal twenty-one inch (21") square, it will be appreciated that no matter where the tile to be cut is positioned relative to the apparatus 120 and the toilet flange F and the surrounding tiles, assuming free rotation of the apparatus 120 within the flange F, if the apparatus 120 is to accommodate such a tile, the distance from the hinge 70 to particularly the first head 32 should be at least approximately seven inches (7") so as to position the head 32 virtually anywhere over the tile T, even at substantially the geometric center of the tile T. In the exemplary embodiment the length of the first and second connecting members 40, 60 is approximately eight inches (8"), yielding an overall length of the apparatus 120 in its substantially closed configuration of approximately fifteen and a half inches (15½") and thus putting the center of the first head 32, or the location of the first center hole 36, approximately eleven and a half inches (11½") from the hinge 70, or long enough to comfortably reach the center of even a 21-inch tile.

The apparatus 120 and assuming up to twenty-one inch (21") tiles are to be accommodated, it is preferable that the overall length of the apparatus 120 be at least fourteen inches (14"), assuming a roughly seven inch (7") first connecting member 40 length and a roughly seven inch (7") diameter first head 32, again, so as to accommodate any such tile and any location of the cut thereon corresponding to the flange location relative to where the tile or other flooring is to be installed.

Again, it will be appreciated by those skilled in the art that the apparatus 120 can easily be scaled up or down depending on the size of tile to be accommodated and other factors. Notably, whatever the case, it is important, as will be appreciated further based on the below discussion of the apparatus in use, that the center of the upper first head 32, and particularly the first center hole 36, be substantially centered over the lower second head 52, and particularly the second centered boss 56, no matter the sizes or configurations of the respective heads 32, 52 or connecting members 40, 60 when the apparatus 120 is in its substantially closed configuration as shown in FIG. 14.

Briefly, in terms of the construction, the first and second arms 30, 50, may be of a unitary construction such as formed of a plastic such as ABS as through a molding process. In such a case, the arms 30, 50 may each be formed so as to be approximately one eighth of an inch (⅛") or perhaps slightly thicker.

Regarding the first center hole 36 formed in the first head 32 and the second centered boss 56 formed on the second head 52, such features may be formed simultaneously with the respective first and second arms 30, 50 or in secondary operations, such as by drilling the center hole 36 or separately molding or otherwise forming the second centered boss 56 and then installing the boss 56 on the second head 52 as through solvent bonding, ultrasonic welding, or any other technique now known or later developed. More generally, those skilled in the art will appreciate that any appropriate material and method of fabrication or construction now known or later developed may be employed in forming the apparatus 120 according to aspects of the present disclosure without departing from its spirit and scope, such that the present configuration, including size and shape and material, is to be understood as expressly non-limiting and merely illustrative.

To complete the exemplary assembly, once the first and second arms 30, 50 are formed, the pin 72 is simply inserted through the formed first and second hinge members 44, 64 so as to form the hinge 70 and thereby pivotally link the first and second arms 30, 50. Again, while a pinned hinge 70 is shown and described, any other such means of linking the first and second arms 30, 50 is possible without departing from the spirit and scope of the toilet flange template apparatus 120.

To summarize, regarding the exemplary embodiments of the present disclosure, it will be appreciated that a toilet flange template apparatus is disclosed and configured for locating a portion thereof substantially centered on the toilet flange even when a tile is placed over the toilet flange so as to thereby enable relatively convenient and accurate marking of a hole cut-out location on the tile substantially corresponding to and providing clearance about the toilet flange. Because the principles of the toilet flange template apparatus may be practiced in a number of configurations beyond those shown and described, it is to be understood that the invention is not in any way limited by the exemplary embodiments, but is generally directed to a toilet flange template apparatus and is able to take numerous forms to do so without departing from the spirit and scope of the invention.

It will also be appreciated by those skilled in the art that the present toilet flange template apparatus is not limited to the particular geometries and materials of construction disclosed, but may instead entail other functionally comparable structures or materials, now known or later developed, without departing from the spirit and scope of the toilet flange template apparatus.

While aspects of the toilet flange template apparatus have been described with reference to at least one exemplary embodiment, it is to be clearly understood by those skilled in the art that the toilet flange template apparatus is not limited thereto. Rather, the scope of the toilet flange template apparatus is to be interpreted only in conjunction with the appended claims and it is made clear, here, that the inventor(s) believe that the claimed subject matter is the invention.

Thus, it has been discovered that the toilet flange template apparatus furnishes important and heretofore unknown and unavailable solutions, capabilities, and functional aspects. The resulting configurations are straightforward, cost-effective, uncomplicated, highly versatile, accurate, sensitive, and effective, and can be implemented by adapting known components for ready, efficient, and economical manufacturing, application, and utilization.

What is claimed is:

1. A toilet flange template apparatus comprising:

a first arm having a first head and a first connecting member extending therefrom, the first head formed with a first centered boss extending therefrom; and a second arm having a second head and a second connecting member extending therefrom, the second arm being pivotally connected to the first arm, and the second arm configured to be parallel to the first arm when a tile is placed therebetween, the second head defining a perimeter edge corresponding to and providing circumferential clearance for an outer circumference of a toilet flange that the first centered boss is configured to mate with.

2. The apparatus of claim 1 further comprising a center hole formed substantially centrally in the first head, the second head, or a combination thereof.

3. The apparatus of claim 1 further comprising a hinge incorporated into the first and second connecting members for pivotally connecting the first and second arms about a single axis.

4. The apparatus of claim 1 wherein the first centered boss has an outer diameter seven-eighths of an inch smaller than an inner diameter of the toilet flange that the first centered boss is configured to mate with.

5. The apparatus of claim 1 wherein the first arm and the second arm are configured to be parallel in a substantially closed configuration and having three-eighths of an inch therebetween.

6. A toilet flange template apparatus comprising:

a first arm having a first head and a first connecting member extending therefrom, the first head formed with a first centered boss extending therefrom;

a second arm having a second head and a second connecting member extending therefrom, the second head formed with a second centered boss extending therefrom, the second arm being pivotally connected to the first arm, and the second arm configured to be parallel to the first arm when a tile is placed therebetween; and wherein:

the second head or the first head defines a perimeter edge corresponding to and providing circumferential clearance for an outer circumference of a toilet flange that the first centered boss or the second centered boss formed on the opposite head is configured to mate with.

7. The apparatus of claim 6 wherein the first head, the second head, or a combination thereof is configured to prevent unwanted debris from entering the toilet flange when the second centered boss or the first centered boss is positioned therein.

8. The apparatus of claim 6 wherein the first centered boss has a smaller outer circumference than the second centered boss.

9. The apparatus of claim 6 wherein the first head and the second head has a diameter of at least three-sixteenths of an inch greater than that of the toilet flange.

10. The apparatus of claim 6 wherein the second centered boss extends further from the second head than the first centered boss extends from the first head.

11. A method of manufacturing a toilet flange template apparatus comprising:

providing a first arm having a first head and a first connecting member extending therefrom, the first head formed with a first centered boss extending therefrom; and coupling a second arm to the first arm, the second arm having a second head and a second connecting member extending therefrom, the second arm being pivotally connected to the first arm, and the second arm configured to be parallel to the first arm when a tile is placed therebetween, the second head defining a perimeter edge corresponding to and providing circumferential clearance for an outer circumference of a toilet flange that the first centered boss is configured to mate with.

12. The method of claim 11 further comprising forming a center hole substantially centrally in the first head, the second head, or a combination thereof.

13. The method of claim 11 wherein coupling includes coupling with a hinge incorporated into the first and second connecting members for pivotally connecting the first and second arms about a single axis.

14. The method of claim 11 wherein providing the first arm includes providing the first arm having the first centered boss having an outer diameter seven-eighths of an inch smaller than an inner diameter of the toilet flange that the first centered boss is configured to mate with.

15. The method of claim 11 wherein coupling the second arm includes coupling the first arm and the second arm configured to be parallel in a substantially closed configuration and having three-eighths of an inch therebetween.

16. The method of claim 11 wherein the second head is formed with a second centered boss extending therefrom.

17. The method of claim 16 wherein providing the first arm or coupling the second arm includes providing the first head, coupling the second head, or a combination thereof configured to prevent unwanted debris from entering the toilet flange when the second centered boss or the first centered boss is positioned therein.

18. The method of claim 16 wherein providing the first arm includes providing the first centered boss having a smaller outer circumference than the second centered boss.

19. The method of claim 16 wherein providing the first arm having the first head or providing the second arm having the second head includes providing the first arm having the first head or providing the second arm having the second head with a diameter of at least three-sixteenths of an inch greater than that of the toilet flange.

20. The method of claim 16 wherein coupling the second arm includes coupling the second arm having the second centered boss extending further from the second head than the first centered boss extends from the first head.

* * * * *